US005501577A

United States Patent [19]

Cornell et al.

[11] Patent Number: 5,501,577

[45] Date of Patent: Mar. 26, 1996

[54] GAS OPERATED PUMP LEAK PREVENTER

[76] Inventors: Gary L. Cornell, 23623 Narcisscus Cir., Moreno Valley, Calif. 92557; Donald G. Vise, 4737 E. Mineral Rd., Phoenix, Ariz. 85044

[21] Appl. No.: 359,059

[22] Filed: Dec. 19, 1994

[51] Int. Cl.[6] ..... F04B 49/10; F01B 1/00

[52] U.S. Cl. ..... 417/9; 417/41; 417/53; 417/63; 417/313; 417/395; 92/79

[58] Field of Search ..... 417/9, 41, 53, 417/63, 313, 395; 92/79

[56] References Cited

U.S. PATENT DOCUMENTS

| | | | |
|---|---|---|---|
| 2,239,270 | 4/1941 | Jahreis | 103/25 |
| 2,703,055 | 3/1955 | Veth et al. | 417/395 |
| 2,769,395 | 11/1956 | Olson, Jr. | 103/12 |
| 3,087,431 | 4/1963 | Bagwell | 103/25 |
| 3,131,638 | 5/1964 | Wilson et al. | 103/44 |
| 3,176,623 | 4/1965 | Howerton et al. | 103/152 |
| 3,807,899 | 4/1974 | Ward et al. | 417/40 |
| 4,740,139 | 4/1988 | Mantell | 417/63 |
| 4,781,535 | 11/1988 | Frawley et al. | 417/63 |
| 4,787,825 | 11/1988 | Mantell | 417/63 |
| 4,856,969 | 8/1989 | Forsythe et al. | 417/395 |
| 4,934,902 | 6/1990 | Mantell | 417/395 |
| 5,062,770 | 11/1991 | Story et al. | 417/63 |

*Primary Examiner*—Richard A. Bertsch
*Assistant Examiner*—Xuan M. Thai
*Attorney, Agent, or Firm*—Christie, Parker & Hale

[57] ABSTRACT

A technique for detecting and containing liquid leaks in a liquid pumping, gas-operated diaphragm pump, and for stopping the pump operation when such leaks occur. If there is a leak in such a pump, the exhaust air gets contaminated with the liquid. With this technique the pump exhaust gas is captured in a container where any liquid within the gas is separated and is allowed to accumulate at the container bottom. The level of liquid accumulated at the container bottom is sensed, and when it reaches a predetermined level, a signal is send to a pneumatically operated shutoff valve to stop the pump operation by stopping the inflow of gas into the pump, or the outflow of liquid from the pump, or to stop the inflow of liquid into the pump. In addition, when the accumulated liquid reaches a predetermined level, a signal may be sent to a pneumatically operated warning device, turning it on.

19 Claims, 1 Drawing Sheet

GAS OPERATED PUMP LEAK PREVENTER

FIELD OF THE INVENTION

This invention relates to a technique for containing and detecting liquid leaks in gas-operated, liquid-pumping diaphragm pumps, and for stopping pump operation when such leaks are detected.

BACKGROUND OF THE INVENTION

Internal leaks in gas operated liquid-pumping pumps result in the discharge of liquid into the atmosphere. When the liquids being pumped are environmentally unsafe, their discharge into the atmosphere may pose significant health risks. The problem of internal leaks is particularly evident with air operated diaphragm pumps. The compressed air driving a diaphragm pump is separated from the liquid being pumped by an elastomeric diaphragm. When a diaphragm failure (e.g., a tear or hole in the diaphragm) occurs, the liquid being pumped mixes with the air driving the pump. In essence, when the pump is on its inlet or suction stroke, the liquid gets sucked through the tear or hole of the failed diaphragm. The liquid contaminates the compressed air. After the pump power function is completed the contaminated air is exhausted to the atmosphere.

The present invention is an apparatus and a method for containing the liquid leaked, for detecting such leak, and for stopping the pump operation when such leak is detected. The present system is driven by the same compressed gas that drives the pump, requiring no other external power source. In essence, once connected to the pump system, a self-contained pump-leak preventer system is formed. While the prior art discloses a system for diaphragm pump leak detection and subsequent shutoff, none discloses the technique of the present invention. The prior art discloses systems that require the use of energy sources other than the gas used to drive the pump. For example, one disclosed system required the use of electricity and another the use of light. In addition, unlike the present invention, some prior art systems require special sensors such as optical sensors.

SUMMARY OF THE INVENTION

The present invention is a technique for detecting and containing liquid leaks in a liquid-pumping, gas-operated diaphragm pump, and for stopping the pump operation when such leaks are detected. Once a leak occurs through the diaphragm, the gas exhausted from the pump is contaminated with the liquid. Under the present technique, the contaminated gas is captured in a container. Except for ports allowing for the inlet and outlet of the pump exhaust gas, the container is sealed. The exhaust gas is fed to the container where the liquid is separated from the gas and accumulates at the container bottom. A sensing mechanism monitors the level of the liquid accumulated at the container bottom. When the liquid reaches a predetermined level within the container, the sensing mechanism sends a signal to a pneumatically operated shutoff valve which either shuts the pump down or stops the flow of liquid into the pump. A signal may also be sent to a warning device, turning it on.

DETAILED DESCRIPTION

Figure 1:
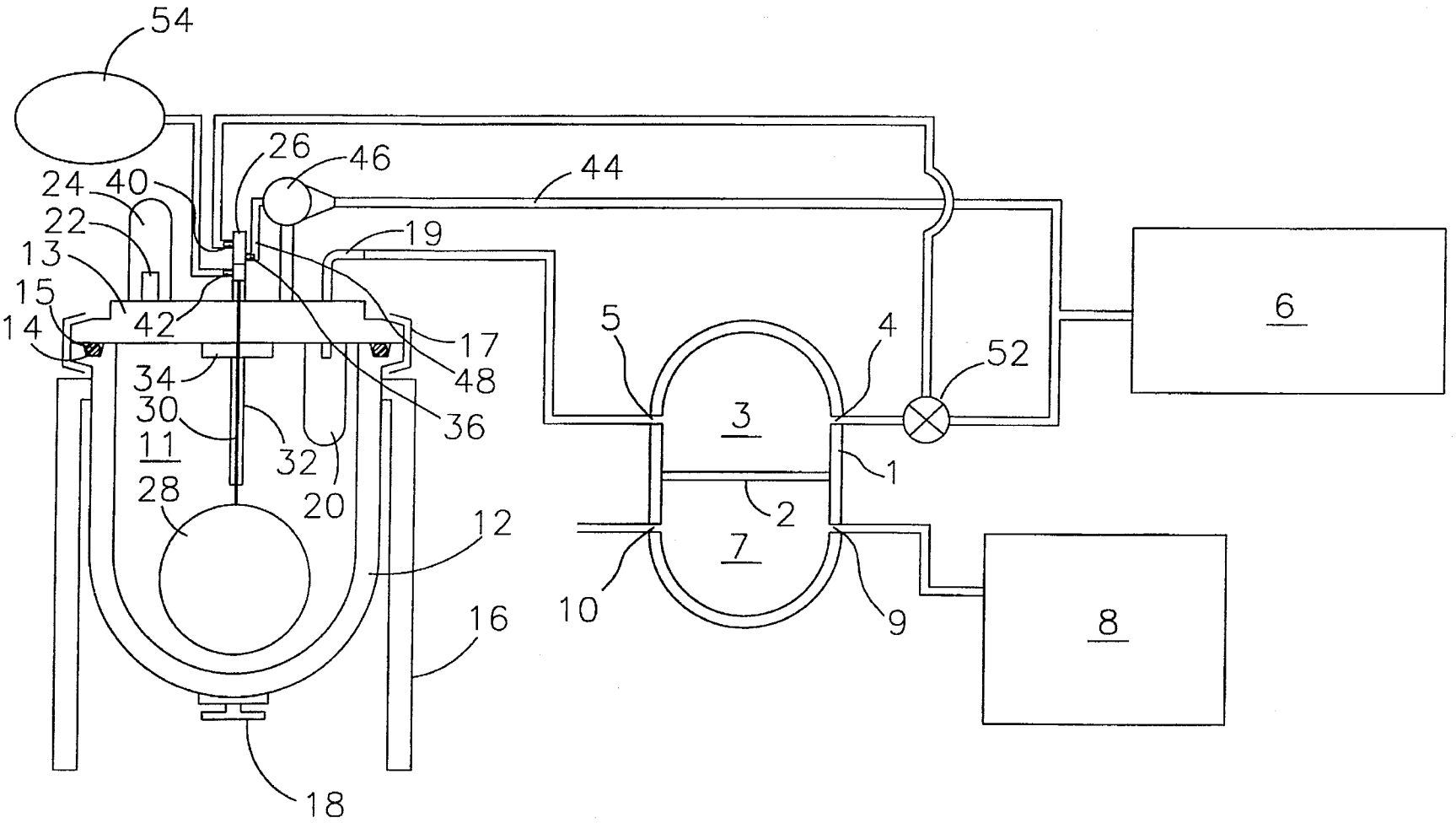
FIG. 1 is a diagram of a leak preventer in operation.

A compressed air operated diaphragm pump 1 is divided into two chambers by an elastomeric diaphragm 2. In one chamber—the compressed air chamber 3—there is an air inlet port 4 and an air outlet port 5. Air, from a compressed air source 6, enters through the inlet port to drive the pump and is exhausted through the outlet port. The other chamber—the liquid chamber 7—also has an inlet and outlet port. Liquid, from a liquid source 8, enters the chamber through the inlet port 9 and is pumped out of the outlet port 10. With time the elastomeric diaphragm may develop tears or holes. As the pumping continues, the liquid being pumped gets sucked through the tear or hole during the pump inlet or suction stroke. This liquid is then mixed with the compressed air and is exhausted to the atmosphere after completion of the pump power stroke.

According to the present invention, the exhaust air from the pump is fed to a container 11. Except for ports allowing for the inlet and outlet of the pump exhaust air, the container is sealed. Typically the container is composed of two pieces, a body 12 and a cover 13. An O-ring type seal 14 which is seated in a groove 15 on the body end face circumference is used to seal the body/cover interface. In an alternative embodiment, the seal is seated in a circumferential groove located on the cover section making contact with the body end face. Generally, the body is supported on a stand 16. The cover is typically held in place on the body by a clamp band type device 17. The body of the container is typically cylindrical with a bowl-shaped (or hemispherical) bottom to hold the accumulated liquid. A drain located at the lowest point of the body is controlled by a stopcock 18.

An inlet port 19 is preferably located on the cover to accommodate the inflow of the pump exhaust from outlet port 5. A diffuser-type device 20, such as a fine mesh screen, is incorporated in line with the inlet port, inside the container, to promote the separation of the liquid from the exhaust air entering the container. Baffles or other means for interrupting the flow of the gas travelling within the container may also be incorporated into the container to foster the separation of liquid from the air. An outlet port 22, also preferably located on the cover, allows for the exhaust of the air from the container to the atmosphere. A muffler-type device 24 is fitted on the outlet to suppress the sound of the air travelling through the container. This muffler-type device also serves as a so-called reclassifier to trap and separate any liquid remaining in the air about to be vented.

A float mechanism is incorporated in the container to sense the level of liquid. This float mechanism controls a pilot valve 26 which is preferably mounted on the exterior of the cover. The float mechanism has a float valve 28 located inside the container. A rod 30, typically made from stainless steel to inhibit corrosion, is connected to the float. The other end of the rod is in contact with, and controls, the pilot valve 26. In alternative embodiments, the rod 30 is connected to the pilot valve 26. The rod is encased in a tube 32, also made from stainless steel. The tube is shorter than the rod. The tube is connected to a bushing 34, also made of stainless steel, which is attached to the interior of the cover. The rod is free to slide inside the tube. The bushing provides the structure for connecting the tube and for sealing the rod/bushing interface to prevent air leakage. The rod penetrates the bushing and cover in order to touch the pilot valve.

The pilot valve has an inlet port 36 and two outlet ports 40 and 42. Using a pressure gas line 44, the compressed air driving the pump is coupled to a pressure regulator 46 which is also coupled to the inlet port of the pilot valve by a pressure gas line 48. For convenience, the pressure regulator is attached to the cover. Outlet port 40 is connected to a pneumatically controlled shutoff valve 52 located in the compressed air inlet line to the pump. The remaining outlet port 42 of the pilot valve may be vented to the atmosphere, or may be coupled to the warning device 54.

All of the air exhausted from the diaphragm pump is coupled to the inlet port of the container. As the air enters the container, it passes through the diffuser-type device. If the air is contaminated with liquid, the diffuser helps separate the liquid from the air. The same result can be accomplished by incorporating baffles inside the container. As the contaminated air comes into contact with the baffle walls, the liquid in the air "sticks" to the walls and flows to the bottom of the container. The more baffles there are, the more wall area is provided to foster the separation of the liquid from the air.

After the liquid is removed, the air escapes from the container through the outlet port and passes through the muffler/reclassifier device. There the sound of the gas travelling through the container is muffled while any liquid that may still remain in the air is trapped and is allowed to drip back into the container. All the liquid removed from the pump exhaust air settles to the bottom of the container. As the liquid accumulates at the bottom of the container, the float rises with the liquid level and moves the rod which operates the pilot valve. When the liquid reaches a predetermined level within the container, the rod redirects the flow paths of the pilot valve.

The pilot valve is fed compressed air from the pressure regulator which is regulating the pressure of the flow from the compressed air source. Under normal operating conditions, the compressed air entering the pilot valve is directed to the outlet port 42 coupled to the shutoff valve, keeping the shutoff valve in the open position. When the liquid reaches the predetermined level, the compressed air is directed to the pilot valve outlet 42 which is either vented to the atmosphere or coupled to the warning device 54. The shutoff valve is actuated to stop the flow of compressed air to the pump, thereby ceasing the pump operation. At the same time, the compressed air entering the pilot valve is either vented to the atmosphere or is fed to the warning device, turning it on.

It should be noted that the present invention is not limited to the type of valves used. For example, the shutoff valve used in the inlet line to the pump may be in the open position when no compressed air is supplied to it and in the closed position when supplied with compressed air. In that situation, when the liquid rises to the predetermined level, the compressed air entering the pilot valve is directed to the shutoff valve to shut off the flow to the pump. Prior to reaching the predetermined level, the compressed air entering the pilot valve is released through the outlet port of the pilot valve vented to the atmosphere. Furthermore, it should be noted that there are many techniques within the spirit of this invention for stopping the pump operation. For example, the shutoff valve can also be used to control the liquid inflow to or outflow from the pump in stopping the pump operation. By shutting off the inflow of liquid to the pump, the pump operation ceases in the sense that liquid can no longer be pumped. However, the pump would still function. By shutting off the outflow from the pump, the pump would stall and subsequently stop functioning.

In essence, the spirit of the invention is to capture the pump exhaust air, separate any liquid contaminating it, collect the separated liquid in a container so that when a predetermined level of liquid is accumulated within the container a signal is sent to a pneumatically operated shutoff valve to shut off the inflow of compressed gas to the pump or the outflow of liquid from the pump causing the pump to shut down, or to shut off the inflow of liquid to the pump, preventing the continuation of the leakage. In addition, a signal may be sent to a pneumatic warning device, turning it on, indicating that the pump is leaking. In alternative embodiments, compressed air can also be directed by the pilot valve to a backup pump which can take over the operation of the failed pump.

What is claimed is:

1. A method for detecting and containing a liquid leak in a compressed gas-operated, liquid pumping diaphragm pump, and for stopping the operation of the pump when such leak is detected, the pump having a gas inlet, a gas exhaust port through which gas escapes from the pump, a liquid inlet and a liquid outlet, the method comprising the steps of:

connecting a source of regulated compressed gas to the gas inlet of the pump;

connecting the exhaust port to a vessel such that liquid entrained in the exhaust gas collects in the bottom of the vessel;

connecting the source of regulated compressed gas to a shutoff valve controlling the flow of gas to the pump inlet;

sensing the level of the liquid that accumulates in the bottom of the vessel; and disconnecting the gas source from the shutoff valve when the sensed level reaches a predetermined value causing the shutoff valve to stop the flow of gas to the pump gas inlet resulting in the shut down of the pump.

2. The method recited in claim 1, wherein the shutoff valve controls the outflow of liquid being pumped from the pump outlet and wherein disconnecting of the gas source to the shutoff valve when the sensed liquid level reaches the predetermined value causes the shutoff valve to stop the liquid outflow from the pump resulting in a pump stall followed by shut down.

3. The method recited in claim 1, wherein the shutoff valve controls the inflow of liquid to the pump inlet and wherein disconnecting of the gas source to the shutoff valve when the sensed liquid level reaches the predetermined value causes the shutoff valve to stop the liquid inflow to the pump preventing any further liquid leakage.

4. The method recited in claim 1, further comprising the steps of connecting the gas source to a pneumatically operated warning device when the sensed level reaches a predetermined value, turning the device on.

5. The method recited in claim 1, further comprising the step of fostering the separation of liquid from the exhaust gas entering the vessel.

6. The method recited in claim 1, further comprising the step of muffling the sound of the gas exiting the vessel.

7. The method recited in claim 1, further comprising the step of trapping any liquid that may remain in the gas exiting the vessel.

8. Apparatus for detecting and containing liquid leaks in a liquid-pumping, gas operated diaphragm pump, and for stopping the operation of the pump when such leak is detected, the pump having a compressed gas source, a gas inlet coupled to the gas source and a gas outlet, a liquid source, a liquid inlet coupled to the liquid source and a liquid outlet, wherein a leak is denoted by liquid contaminated pump exhaust gas, comprising:

means for containing the liquid leaked;

means for coupling the pump exhaust to the containing means;

means for venting the containing means;

means for sensing the level of leaked liquid accumulated in the containing means;

means responsive to the sensing means for pneumatically shutting off the pump when the accumulated liquid in the containing means reaches a predetermined level.

9. An apparatus as recited in claim 8, wherein the means for sensing the liquid level comprises a float mechanism.

10. An apparatus as recited in claim 8, further comprising means for fostering the separation of the liquid from the exhaust gas in the containing means.

11. An apparatus as recited in claim 10, wherein the means fostering the separation of the liquid from the exhaust gas is a diffuser.

12. An apparatus as recited in claim 10, wherein the means fostering the separation of the liquid are baffles located in the containing means.

13. An apparatus as recited in claim 8, further comprising a device attached to the venting means for muffling of sounds generated by the exhaust gas entering and venting from the containing means and for trapping any liquid that may remain in the exhaust gas being vented.

14. An apparatus as recited in claim 8, wherein the means responsive to the sensing means pneumatically shuts off the inflow of liquid to pump liquid inlet.

15. An apparatus as recited in claim 8, wherein the means for pneumatically shutting off the pump, further comprises:

a pilot valve controlled by the liquid level sensing means, with an inlet and a plurality of outlets;

means for coupling the compressed gas source to the pilot valve inlet;

means for regulating the pressure of the compressed gas source coupled to the pilot valve inlet;

a pneumatically operated shutoff valve controlling the flow of gas to the pump inlet; and means for coupling a pilot valve outlet to the shutoff valve.

16. An apparatus as recited in claim 15, wherein the pneumatically operated shutoff valve controls the outflow of liquid from the pump.

17. An apparatus as recited in claim 15, further comprising means for warning of pump leaks.

18. An apparatus as recited in claim 17, wherein the means for warning of pump leaks, further comprises:

a pneumatically operated warning device; and means of coupling a pilot valve outlet to the warning device.

19. An apparatus for detecting and containing leaks in a liquid-pumping, air operated diaphragm pump, and for shutting the pump off and warning of the leaks when such leaks are detected, the pump having a compressed gas source, a gas inlet coupled to the gas source and a gas outlet, wherein a leak is denoted by liquid contaminated pump exhaust gas, comprising:

a vessel for containing the exhaust gas, comprising:

an opening for inflow of the exhaust gas from the pump, a diffuser promoting the separation of the liquid from the exhaust gas, an opening for outflow of the exhaust gas, further comprising a muffler type device for the muffling of the sound of the exhaust gas inflowing and outflowing from the vessel and for trapping any liquid that may remain in the exhaust gas outflowing from the vessel, and a float-type mechanism for sensing the level of liquid accumulated in the vessel;

a pilot valve, controlled by the float-type mechanism, with an inlet and a plurality of outlets;

means for coupling the compressed gas source to the pilot valve inlet;

means for regulating the pressure of the compressed gas source coupled to the pilot valve inlet;

a pneumatically operated shutoff valve located on the pump inlet coupling means;

means for coupling an outlet of the pilot valve to the shutoff valve;

a pneumatically operated indicator for warning of pump leaks; and means for coupling an outlet of the pilot valve to the indicator.

* * * * *